US007462053B2

(12) United States Patent
Little et al.

(10) Patent No.: US 7,462,053 B2
(45) Date of Patent: Dec. 9, 2008

(54) ELECTRICAL CONTACT AND PROCESS FOR MAKING THE SAME AND CONNECTOR COMPRISING THE SAME

(75) Inventors: Terrance F. Little, York, PA (US); Tod M. Harlan, Mechanicsburg, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 79 days.

(21) Appl. No.: 11/481,202

(22) Filed: Jul. 3, 2006

(65) Prior Publication Data

US 2008/0003858 A1 Jan. 3, 2008

(51) Int. Cl.
*H01R 13/15* (2006.01)

(52) U.S. Cl. ..... 439/260; 439/856

(58) Field of Classification Search ..... 439/856, 439/260, 857, 495
See application file for complete search history.

(56) References Cited

U.S. PATENT DOCUMENTS

| | | | | |
|---|---|---|---|---|
| 5,409,406 | A * | 4/1995 | McClure | 439/857 |
| 5,709,573 | A * | 1/1998 | McClure | 439/857 |
| 5,906,498 | A * | 5/1999 | Nagafuji | 439/260 |
| 7,008,250 | B2 * | 3/2006 | Shuey et al. | 439/265 |
| 2006/0073724 | A1 * | 4/2006 | Shuey et al. | 439/265 |

* cited by examiner

*Primary Examiner*—Gary F. Paumen
(74) *Attorney, Agent, or Firm*—Wei Te Chung

(57) ABSTRACT

A method of fabricating an electrical connector contact comprising the steps of providing a conductive contact including opposing beams defining a contact gap therebetween and a joint portion joining the opposing beams and re-positioning at least one of the beams to reduce dimension of the contact gap by applying a force to the contact to make it be displaced.

11 Claims, 6 Drawing Sheets

ELECTRICAL CONTACT AND PROCESS FOR MAKING THE SAME AND CONNECTOR COMPRISING THE SAME

BACKGROUND OF THE INVENTION

1. Field of the Invention

The present invention relates generally to electrical connectors and more specifically to a connector contact comprising two opposing beams with a gap therebetween. The invention also relates to a process for fabricating such contacts.

2. Description of Related Art

Conductive contacts comprising two opposing beams with a gap therebetween are widely used in connectors for connecting a flexible printed circuit or cable (FPC), a flexible flat cable (FFC) and so forth. All of these cables and circuits will be generally referred to as "FPC" hereafter for convenience. Due to the trend toward small dimensional electronic components, today's connectors are increasingly characterized by lower profile thereof. In response to this lower profile request, contact gaps of contacts should be minimized. However, the contact with an extremely small contact gap would be difficult to blank under normal stamping conditions.

In addition, to allow the FPC being inserted into the contact gap with Zero-Insertion-Force, one of the beams, usually the upper beam, is deflectable by driving of an actuator so that when the actuator is opened for insertion of the FPC, the upper beam is opened up by a cam portion of the actuator for broadening the contact gap to receive the FPC, and when the actuator is closed, the normal force from the upper beam is applied to the FPC to make electrical contact. It is expected to ensure that the normal force applied to the FPC from the upper beam is high enough to achieve a reliable connection between the FPC and the contacts, especially after repeated opening and closing operation driven by the actuator.

Therefore, it is desired to have a contact in which the contact gap is minimized and the normal force applied to the FPC from the upper beam is high enough to ensure a reliable electrical connection.

SUMMARY OF THE INVENTION

An object of the present invention is to provide a conductive contact with a small contact gap.

A second object of the present invention is to provide a conductive contact from which the normal force applied to the FPC is high enough to ensure a firm electrical connection.

A third object of present invention is to provide a two-step process for fabricating conductive contacts with small contact gap.

In order to achieve above-mentioned objects, a contact in accordance with the preferred embodiment of the present invention is fabricated by a method comprising the steps of providing a conductive contact including opposing beams defining a contact gap therebetween and a joint portion joining the opposing beams and re-positioning at least one of the beams to reduce dimension of the contact gap by applying a force to the contact to make it be displaced.

Other objects, advantages and novel features of the present invention will become more apparent from the following detailed description of the present embodiment when taken in conjunction with the accompanying drawings.

DETAILED DESCRIPTION OF THE INVENTION

Figure 1:
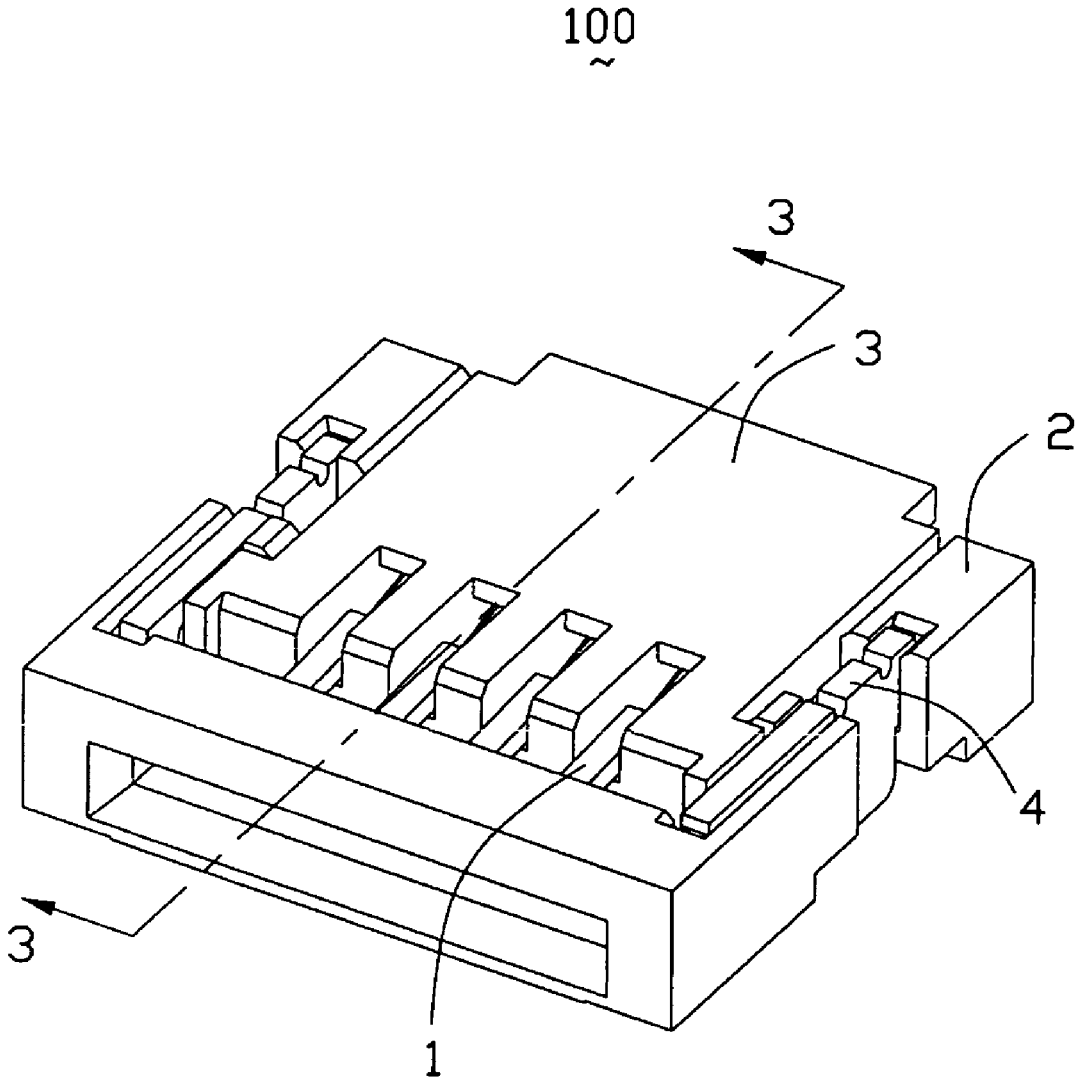
FIG. 1 is an assembled perspective view of an FPC connector including contacts in accordance with a preferred embodiment of the present invention.
Figure 2:
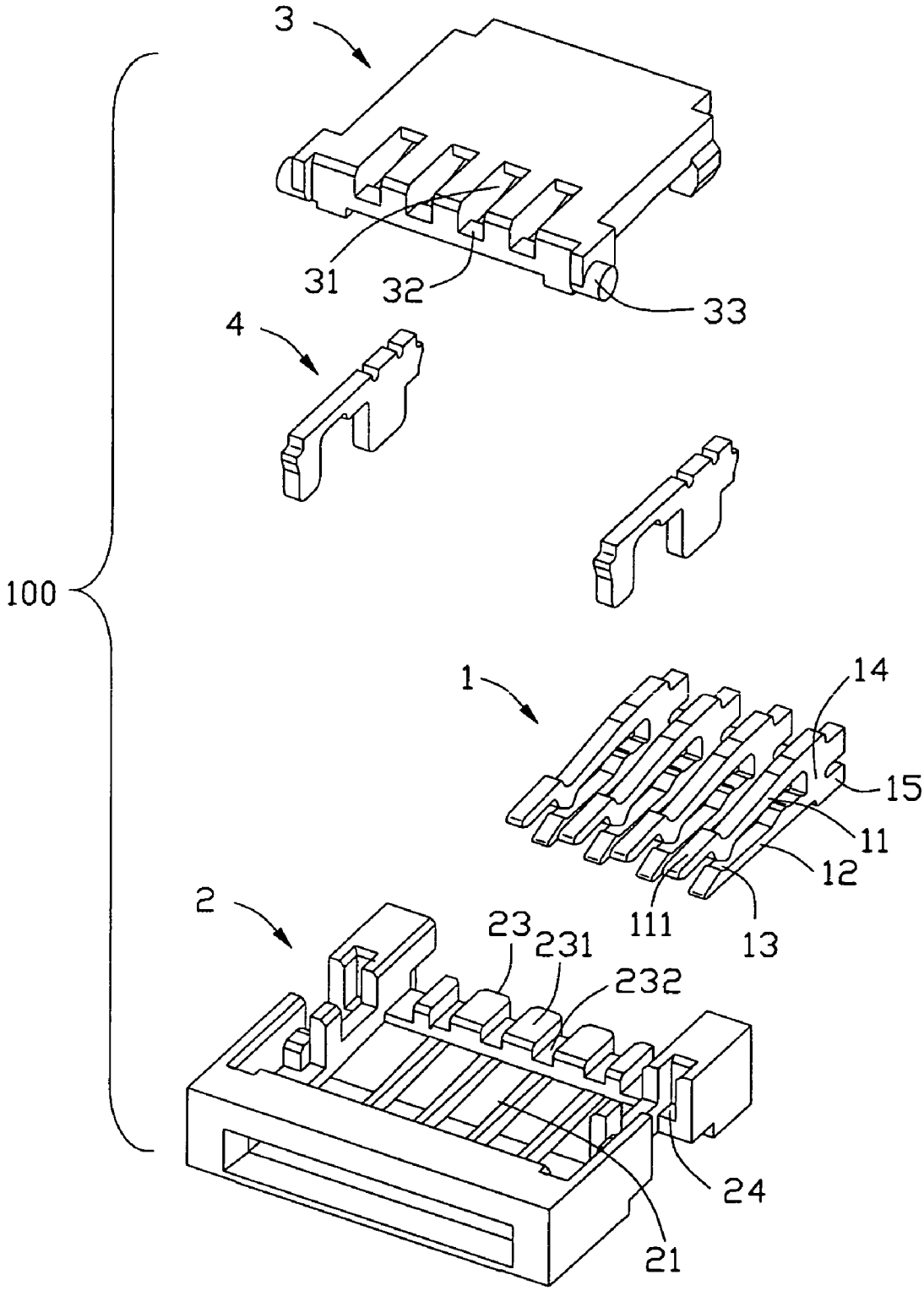
FIG. 2 is an exploded perspective view of the FPC connector shown in FIG. 1.
Figure 3:
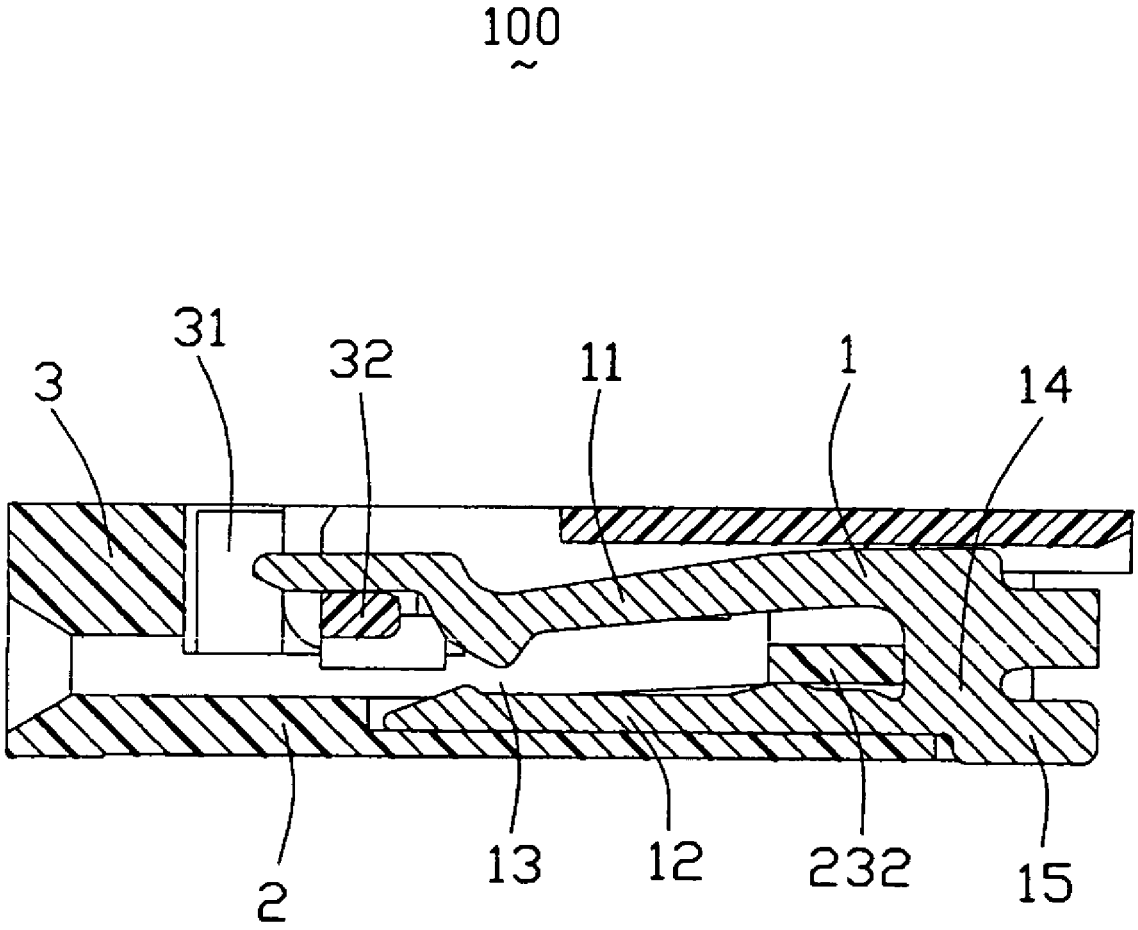
FIG. 3 is a cross-sectional view of FIG. 1 taken along line 3-3, wherein an actuator is placed at a closed position.
Figure 4:
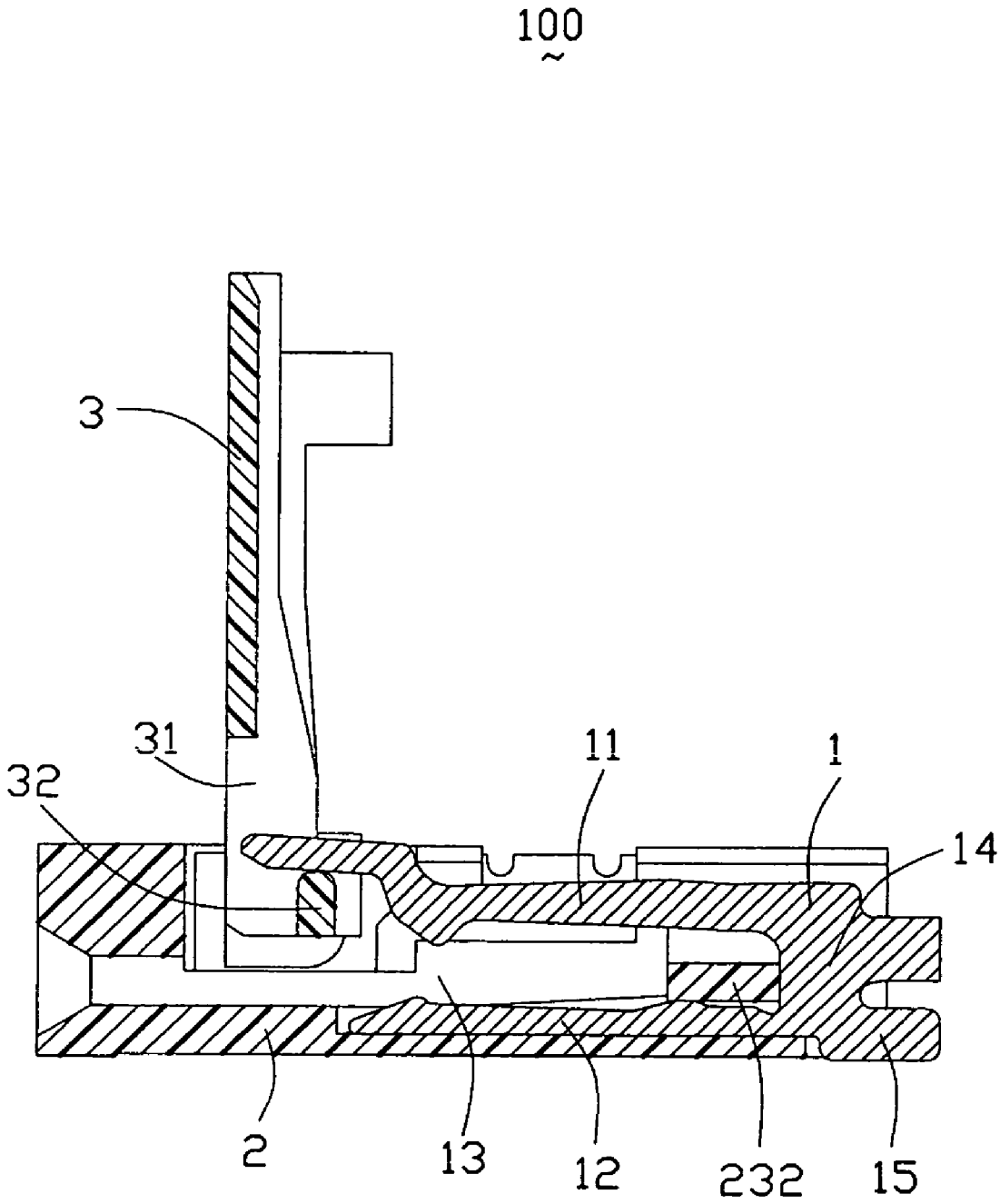
FIG. 4 is a cross-sectional view similar to FIG. 3, but wherein the actuator has been rotated to an open position.

The present invention will be discussed hereafter in detail in terms of the embodiments of the present invention. However, any well-known structure or process is not described in detail in order to avoid unnecessary verbosity.

Referring to FIGS. 1-4, by way of example, a plurality of contacts 1 in accordance with the embodiment of the present invention are designed to be used in an FPC connector 100 for connecting an FPC (not shown). Each contact 1 comprises an upper beam 11 and a lower beam 12 defining therebetween a gap, the minimal 13 of which serves as a contact gap for contactably receiving the FPC, a joint portion 14 joining the upper beam 11 and lower beam 12, and a solder foot 15 extending from the joint portion 14 for being soldered to a printed circuit board (not shown).

The connector 100 further comprises a housing 2 for receiving the contacts 1 and an actuator 3 for urging the contact 1 to open for receiving the FPC and to close for establishing electrical connection with the FPC, and a pair of retaining ears or end clips 4 for retaining the actuator 3 in the housing 2. The housing 2 has an upward opening 21 in the top face thereof and a contact-retaining portion 23 adjacent to the rear face thereof. The contact-retaining portion 23 comprises a plurality of ribs 231 and spines 232 between every two adjacent ribs 231. During assembling, the contacts 1 are forwardly inserted in the opening 21 each to be retained between two adjacent ribs 231 and to have the spine 232 forced through the contact gap 13 to be accommodated between the opposing beams 11 and 12. The actuator 3 is formed into a plate form with an engaging edge comprising a plurality of through holes 31 provided for the free ends 111 of the upper beams 11 to go through during pivotal rotation of the actuator 3, a plurality of cam portions 32 provided by the forming of the through holes 31, and a pair of end shafts 33 respectively extending from longitudinal ends thereof. In assembly, the cam portions 32 are respectively positioned under the free end 111 of the upper beams 11, and the end shafts 33 rotatably rest in recesses 24 defined at the side portions of the housing 2 and further restricted by the retaining ears or clips 4 assembled to the recess 24. Thereby the actuator 3 is rotatably pivoting on the shaft portions 33 between an open position where the upper beams 11 are opened up by the cam portions 32 for receiving the FPC and a closed position where the upper beams 11 close to original position to apply a normal force to the FPC received in the contact gaps 13.

Figure 5:
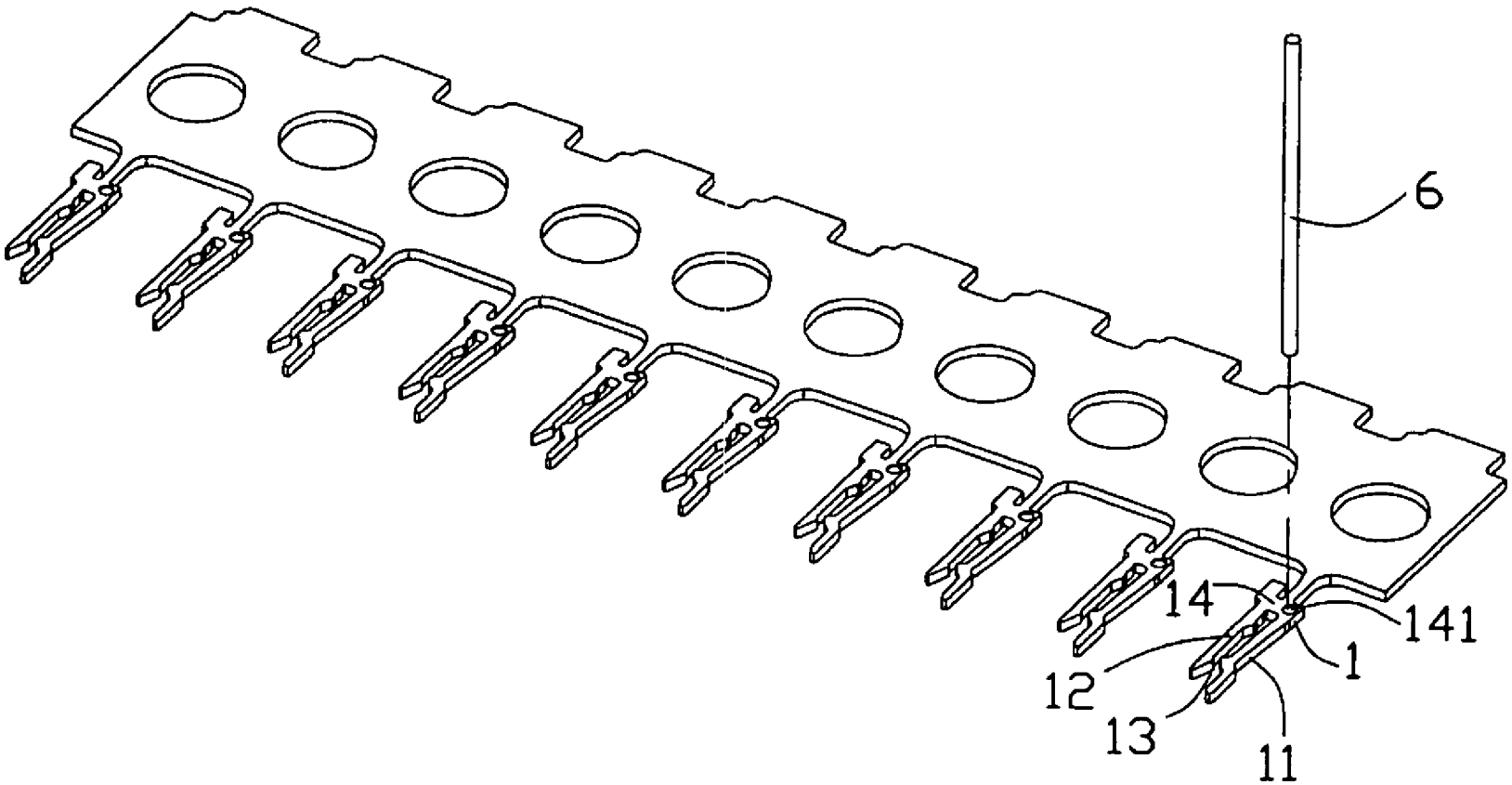
FIG. 5 is a perspective view of a strip of contacts schematically showing the fabricating process of the contacts in accordance with the preferred embodiment of the present invention.

Referring to FIG. 5, the contact 1 and the process by which it is fabricated will be detailedly described hereafter. Generally, contacts are formed into their final configurations directly through a stamping process in which a metal strip is punched into a plurality of patterned blanks which are then progressively formed into the final contact configuration. However, in response to the lower profile request of the connector 100, the contact gap 13 here should be reduced to a desired dimension. For example, in the case that the height of the connector is reduced to 0.8 mm, then the contact gap 13 should be reduced to less than 0.06 mm. But such a small gap is difficult to blank under the stamping conditions because a punch with such a thin profile would not be able to withstand the stamping pressure. Thus the present invention introduces essentially a two-step process to fabricate the contact 1 with a minimal contact gap. The two-step process includes a normal stamping process for initially providing the contact with a normal contact gap dimension and a re-positioning process for subsequently re-positioning and closing one or both of the two opposing beams to reduce the contact gap to a desired dimension.

Firstly, the contacts 1 are stamped from an elongated metal strip processed by a progressive or multistage punch press. As the strip is advanced progressively or indexed through the press, the strip is punched into a plurality of patterned blanks which are then progressively formed into the initial contact configuration. These initially finished contacts 1 are joined by a web thereby facilitating their subsequent separation and installation.

Subsequently, the strip of initially finished contacts 1 which are still joined by a web is set up, in possibly the same stamping die or in a different fixture, for the re-positioning operation. The re-positioning operation can be achieved by, for example, what is referred to as a tonking process. The tonking process is to drive a pointed punch 6 against a predetermined location on the contact 1 so that the material is displaced in a fashion in which one or more of the contact beams 11, 12 will be moved or re-positioned. The tonking punch direction is generally perpendicular to a plane defined by the two opposing beams 11 and 12, i.e., along a direction perpendicular to the strip from which the contacts 1 are stamped. The best location for the tonking punch can be evaluated by comparing the effects on moving the upper beam 11 and the effects of normal force in the upper beam 11 by tonking varied locations of the contact. Evaluation of the effects of normal force can be determined through a normal force measuring gauge. By way of example, a preferred punch location 141 is at the joint portion 14 adjacent to the upper beam 11, as best shown in FIG. 6.

Figure 6:
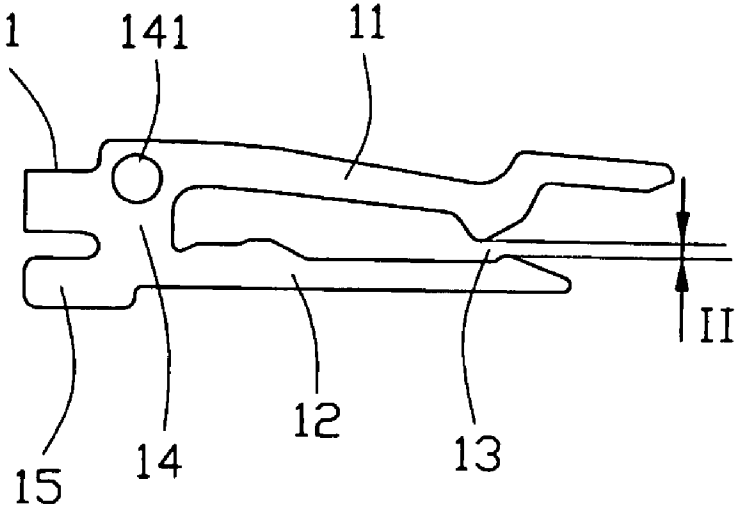
FIG. 6 is a view contrastingly showing a contact prior to being processed and a contact after being processed.
Figure 6:
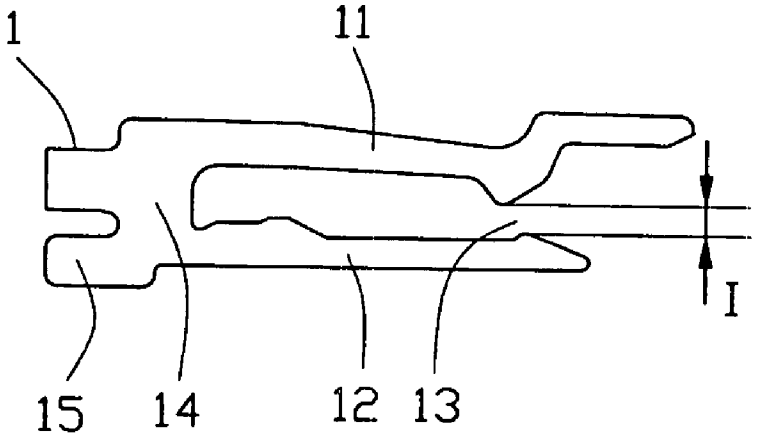

Referring to FIG. 6, as a result of the tonking operation, the upper beam 11 closes up to the lower beam 12 thereby dimension of the contact gap 13 is reduced from I to II. Based on the desired contact gap dimension, the tonking punch diameter and the tonking depth can be adjusted. By way of example, to reduce the contact gap from 0.14 mm to 0.06 mm or less, a punch with a 0.5 mm diameter and pin-tapered to 0.2 mm would be used, and a 0.038 mm punch depth would be preferred.

Through such a tonking process, a desired minimal gap dimension is achieved, and a higher normal force from the upper beam 11 is achieved due to work hardening of the material by tonking the high stress area of the contact beam 11 or 12. Moreover, in this way, the pre-existing contacts used in a higher profile connector can be used in the lower profile connector after their contact gaps are reduced by the tonking process without re-designing the contacts. Furthermore, the tonking process can be done either prior to a plating process or "post-plating", which can facilitate production of the contacts.

Another re-positioning method is to coin one or both of the two opposing beams 11, 12. By compressing the beam 11 or 12 at a desired location in the direction perpendicular to a plane defined by the two opposing beams 11 and 12, i.e. the direction is perpendicular to the strip from which the contacts 1 stamped, the material is displaced to reduce the contact gap 13. By way of example, compressing the free end of the upper beam 11 would displace its material towards the lower beam 12 and therefore reduce the contact gap 13. Also, there are still other methods to re-position the beam 11 or 12, for example, to use slide cams in the die to apply sideward force to the contact beam 11 or 12, thus closing the beams 11 and 12 in a fashion similar to that of the tonking process.

It will be obvious to those skilled in the art that many changes and modifications in the preferred embodiments of the invention can be made without departing from the scope of the invention.

What is claimed is:

1. A method of fabricating an electrical connector contact, comprising the steps of:

providing a conductive contact including opposing beams defining a contact gap therebetween and a joint portion joining the opposing beams; and re-positioning at least one of the beams to reduce a dimension of the contact gap by applying a force to the joint portion to displace the contact material while keeping the joint portion still in an original plane thereof.

2. The method according to claim 1, wherein the step of re-positioning by applying a force comprises applying the force to the joint portion in a direction substantially perpendicular to the joint portion.

3. The method according to claim 2, wherein said re-positioning step comprises tonking on the joint portion of the contact with a punch.

4. The method according to claim 3, wherein said tonking step comprises punching a location at the joint portion adjacent to one of the beams.

5. The method according to claim 1, wherein the opposing beams and the joint portion are in a same plane.

6. An electrical connector contact comprising two opposing beams defining a contact gap therebetween and a joint portion joining the opposing beams; wherein at least one of the beams is re-positioned in a fashion in which a dimension of the contact gap is reduced and the contact is still kept in an original plane thereof; wherein the joint portion and the beams are in a same plane and the material of the joint portion is displaced by a force in a direction substantially perpendicular to the plane.

7. The contact as claimed in claim 6, wherein the contact gap is less than 0.06 mm.

8. An electrical connector comprising a housing, an actuator pivotly mounted on the housing and a plurality of contacts urged by the actuator, each contact comprising: two opposing beams defining a contact gap therebetween, the two beams respectively having a contact point thereof and one of the beams defines one portion extending forwardly to cooperate with the actuator, and a joint portion jointing the opposing beams, wherein said one beam is re-positioned in a fashion in which dimension of the contact gap is reduced and the contact is still kept in an original plane thereof; wherein the joint portion and the beams are in a same plane and the material of the joint portion is displaced by a force in a direction substantially perpendicular to the plane.

9. The electrical connector as claimed in claim 8, said re-positioned beam is longer than the other.

10. The electrical connector as claimed in claim 8, wherein said joint portion is displaced at a position closer to the re-positioned beam than the other beam.

11. The electrical connector as claimed in claim 8, wherein said joint portion is kinked at said position to form a dimple while said dimple is still fully surrounded by remaining planar portions of said joint portion.

* * * * *